US008291706B2

(12) United States Patent
Tanner et al.

(10) Patent No.: US 8,291,706 B2
(45) Date of Patent: Oct. 23, 2012

(54) FUEL INJECTOR BEARING PLATE ASSEMBLY AND SWIRLER ASSEMBLY

(75) Inventors: Keith M. Tanner, Colchester, CT (US); Philip J. Kirsopp, Lebanon, CT (US)

(73) Assignee: United Technologies Corporation, Hartford, CT (US)

( * ) Notice: Subject to any disclaimer, the term of this patent is extended or adjusted under 35 U.S.C. 154(b) by 788 days.

(21) Appl. No.: 12/482,516

(22) Filed: Jun. 11, 2009

(65) Prior Publication Data

US 2012/0198653 A1 Aug. 9, 2012

Related U.S. Application Data

(62) Division of application No. 11/085,493, filed on Mar. 21, 2005, now Pat. No. 7,628,019.

(51) Int. Cl.
*F02C 1/00* (2006.01)
*F02G 3/00* (2006.01)

(52) U.S. Cl. ..... 60/740; 60/737; 60/800; 60/796; 239/587.1

(58) Field of Classification Search ..... 239/587.1, 239/587.3, 587.4, 587.5, 533.2, 399; 60/740, 60/748, 796, 799, 800
See application file for complete search history.

(56) References Cited

U.S. PATENT DOCUMENTS

| | | | | |
|---|---|---|---|---|
| 3,458,997 | A | 8/1969 | Joseph | |
| 4,322,945 | A * | 4/1982 | Peterson et al. | 60/800 |
| 4,365,470 | A * | 12/1982 | Matthews et al. | 60/800 |
| 4,454,711 | A | 6/1984 | Ben-Porat et al. | |
| 4,693,074 | A | 9/1987 | Pidcock et al. | |
| 4,870,818 | A * | 10/1989 | Suliga | 60/740 |
| 5,373,693 | A * | 12/1994 | Zarzalis et al. | 60/39.23 |
| 5,490,378 | A * | 2/1996 | Berger et al. | 60/39.23 |
| 5,577,379 | A * | 11/1996 | Johnson | 60/796 |
| 5,916,142 | A | 6/1999 | Snyder et al. | |
| 5,996,335 | A * | 12/1999 | Ebel | 60/800 |
| 6,035,645 | A * | 3/2000 | Bensaadi et al. | 60/742 |
| 6,212,870 | B1 | 4/2001 | Thompson et al. | |
| 6,324,830 | B1 * | 12/2001 | Spooner et al. | 60/796 |
| 6,460,340 | B1 * | 10/2002 | Chauvette et al. | 60/740 |
| 6,497,105 | B1 * | 12/2002 | Stastny | 60/796 |
| 6,502,400 | B1 * | 1/2003 | Freidauer et al. | 60/772 |
| 6,546,732 | B1 | 4/2003 | Young et al. | |

(Continued)

FOREIGN PATENT DOCUMENTS

| | | |
|---|---|---|
| EP | 0837284 | 4/1998 |
| GB | 1505499 | 3/1978 |

OTHER PUBLICATIONS

European Search Report dated Nov. 21, 2007.

(Continued)

*Primary Examiner* — William H Rodriguez
(74) *Attorney, Agent, or Firm* — Carlson, Gaskey & Olds, PC

(57) ABSTRACT

A bearing plate assembly for a turbine engine fuel injector includes a bearing plate 30, with an opening 80 bordered by a race 82. A swivel ball 90 nests inside the race and is rotatable relative thereto. A lock, which may be a tip bushing 108 resists disengagement of the swivel ball from the race. A fuel injector nozzle 38 extends through an opening 98 in the swivel ball. During engine operation, the ball can swivel inside the race to accommodate rotational movement of the nozzle about lateral and radial axes.

12 Claims, 7 Drawing Sheets

U.S. PATENT DOCUMENTS

| | | | | |
|---|---|---|---|---|
| 6,959,551 | B2 * | 11/2005 | Baudoin et al. | 60/748 |
| 7,104,066 | B2 | 9/2006 | Leen et al. | |
| 7,114,337 | B2 * | 10/2006 | Cazalens et al. | 60/737 |
| 7,131,273 | B2 * | 11/2006 | Howell et al. | 60/748 |
| 7,246,494 | B2 | 7/2007 | Currin et al. | |
| 7,478,534 | B2 * | 1/2009 | Guezengar et al. | 60/796 |
| 7,591,136 | B2 * | 9/2009 | Bernier et al. | 60/800 |
| 7,861,529 | B2 * | 1/2011 | Commaret et al. | 60/742 |
| 7,926,280 | B2 * | 4/2011 | Morenko et al. | 60/740 |
| 2006/0042268 | A1 * | 3/2006 | Markarian et al. | 60/796 |
| 2007/0084215 | A1 | 4/2007 | Hernandez et al. | |

OTHER PUBLICATIONS

European Search Report dated Apr. 11, 2006.

* cited by examiner

FUEL INJECTOR BEARING PLATE ASSEMBLY AND SWIRLER ASSEMBLY

RELATED APPLICATION

This application is a divisional of U.S. patent application Ser. No. 11/085,493, which was filed Mar. 21, 2005 now U.S. Pat. No. 7,628,019.

STATEMENT OF GOVERNMENT INTEREST

This invention was made under U.S. Government Contract N00019-02-C-3003. The Government has certain rights in the invention.

TECHNICAL FIELD

This invention relates to fuel injector bearing plate assemblies and air swirler assemblies for turbine engines, and particularly to assemblies that accommodate rotational movement of a fuel injector.

BACKGROUND OF THE INVENTION

The combustor module of a modern aircraft gas turbine engine includes an annular combustor circumscribed by a case. The combustor includes radially inner and outer liners and a bulkhead extending radially between the forward ends of the liners. A series of openings penetrates the bulkhead. An air swirler with a large central opening occupies each bulkhead opening. A fuel injector bearing plate with a relatively small, cylindrical central opening is clamped against the swirler in a way that allows the bearing plate to slide or "float" relative to the swirler.

The combustor module also includes a fuel injector for supplying fuel to the combustor. The fuel injector has a stem secured to the case and projecting radially inwardly therefrom. A nozzle, which is integral with the stem, extends substantially perpendicularly from the stem and projects through the cylindrical opening in the bearing plate. The portion of the nozzle that projects through the bearing plate is cylindrical and has an outer diameter nearly equal to the diameter of the opening in the bearing plate.

During engine operation, combustion air enters the front end of the combustor by way of the air swirler. The swirler swirls the incoming air to thoroughly blend it with the fuel supplied by the fuel injector. The thorough blending helps minimize undesirable exhaust emissions from the combustor. The swirler also regulates the quantity of air delivered to the front end of the combustor. This is important because excessive air can extinguish the combustion flame, a problem known as lean blowout. Turbine engines are especially susceptible to lean blowout when operated at or near idle and/or when decelerated abruptly from high power. The aforementioned near-equivalent diameters of the fuel nozzle and the opening in the bearing plate help prevent air leakage that would make the combustor more vulnerable to lean blowout.

During engine operation, the components near the front end of the combustor, such as the air swirler and bulkhead, are exposed to high temperatures due to their proximity to the combustion flame. The fuel injector stem, and the case to which the stem is mounted, are exposed to relatively lower temperatures. The temperature differences cause these components to expand and contract differently, which displaces the fuel nozzle radially and/or circumferentially relative to the swirler. The fact that the bearing plate is slidably mounted to the swirler, as noted above, allows the bearing plate to slide and accommodate the displacement of the nozzle while continuing to prevent detrimental air leakage in the vicinity of the nozzle.

Although conventional bearing plates are effective at accommodating translational displacement of the nozzle relative to the swirler, they cannot readily accommodate changes in the angular orientation of the nozzle. For example, if thermal gradients, pressure loading or other influences cause the nozzle and/or the bulkhead to rotate about a laterally or radially extending axis, the nozzle and/or the central opening in the bearing plate can experience fretting wear. This wear can allow air leakage through the opening, which makes the combustor more susceptible to lean blowout. In extreme circumstances, the rotational movement can fracture the fuel nozzle. In addition, the rotational movement of the nozzle can pull the bearing plate away from the swirler (a phenomenon known as "burping") which allows undesirable air leakage past the planar interface between the bearing plate and the swirler.

What is needed is a fuel injector bearing plate assembly and a swirler assembly that accommodate rotation of the fuel injector nozzle relative to the combustor hardware (for example the bulkhead and swirler).

SUMMARY OF THE INVENTION

According to one embodiment of the invention, a bearing plate assembly includes a bearing plate with a fuel injector opening bordered by a race with a curved inner surface. A swivel ball with an outer surface geometrically similar to the race inner surface is trapped in the opening by a lock. During engine operation, the swivel ball is capable of swiveling in the race to accommodate rotation of a fuel injector nozzle projecting through the swivel ball.

In a more detailed embodiment, the curved surfaces are spherical.

In another more detailed embodiment, the bearing plate includes tabs to facilitate its slidable attachment to a swirler.

The foregoing and other features of the various embodiments of the invention will become more apparent from the following description of the best mode for carrying out the invention and the accompanying drawings.

BEST MODE FOR CARRYING OUT THE INVENTION

Figure 1:
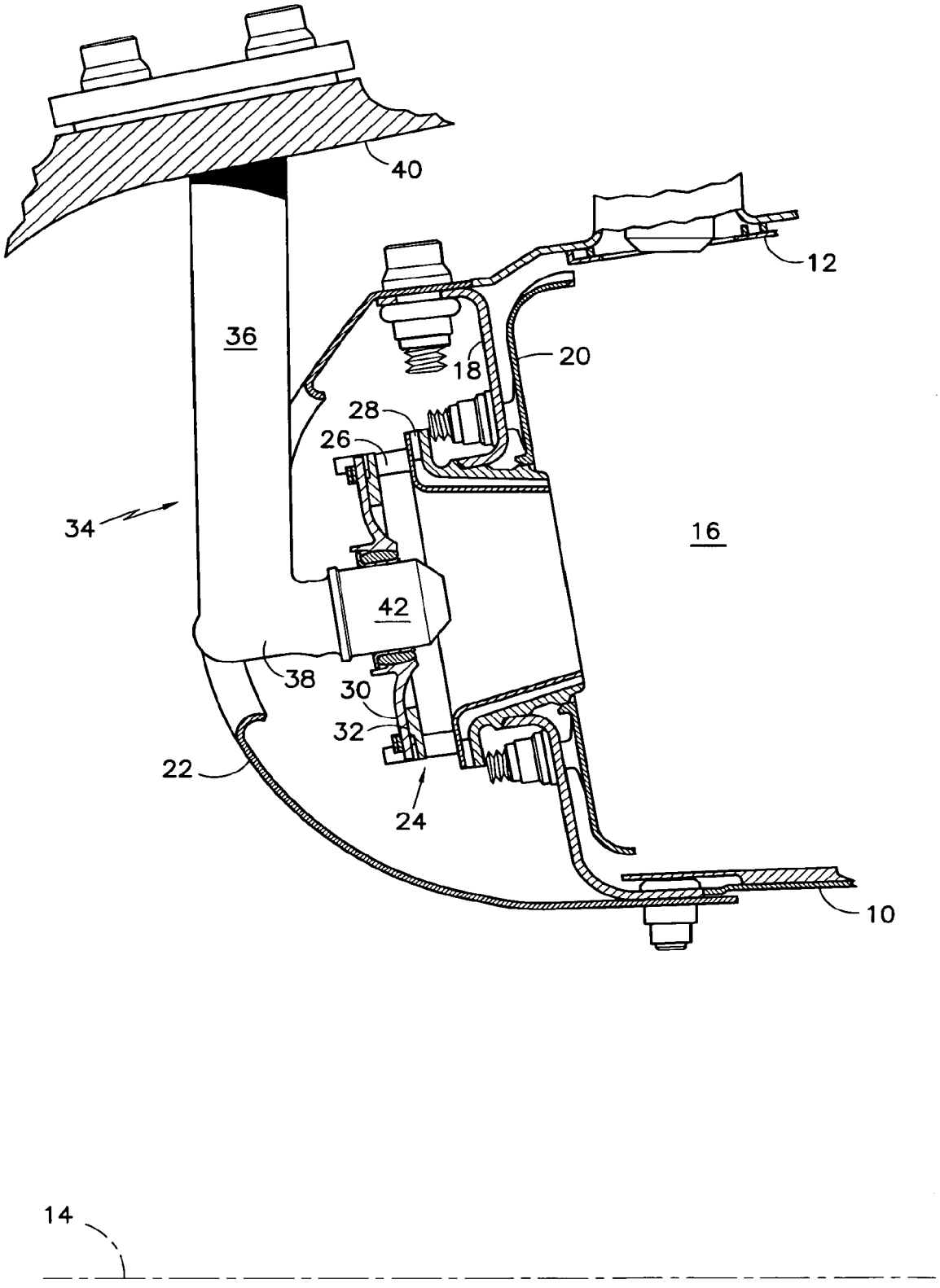
FIG. 1 is a cross sectional side elevation view of the forward end of an annular combustor for a turbine engine showing the preferred embodiment of an air swirler assembly and a bearing plate assembly according to the present invention.

FIG. 1 shows a gas turbine engine annular combustor having inner and outer liners, 10, 12 circumscribing an engine axis 14 to define an annular combustion chamber 16. A bulkhead 18 and a bulkhead heatshield 20 extend radially between the forward ends of the liners. An annular hood or dome 22 covers the front end of the combustor. An air swirler 24 occupies central openings in the bulkhead and heatshield. During engine operation, the swirler guides air radially and then axially into the combustion chamber. Tandem sets of swirl vanes 26, 28 impart swirl to the air as it enters the swirler. A fuel injector bearing plate 30 is clamped against the forward end of the swirler tightly enough to resist air leakage past the interface or contact plane 32 between the bearing plate and the swirler but loosely enough to allow the bearing plate to slide or float radially and circumferentially relative to the swirler.

A fuel injector 34 comprises a radially extending stem 36 and a nozzle 38 integral with the stem and extending approximately perpendicularly therefrom. The stem is secured to an engine case 40. At least a portion 42 of the nozzle is cylindrical.

Figure 2:
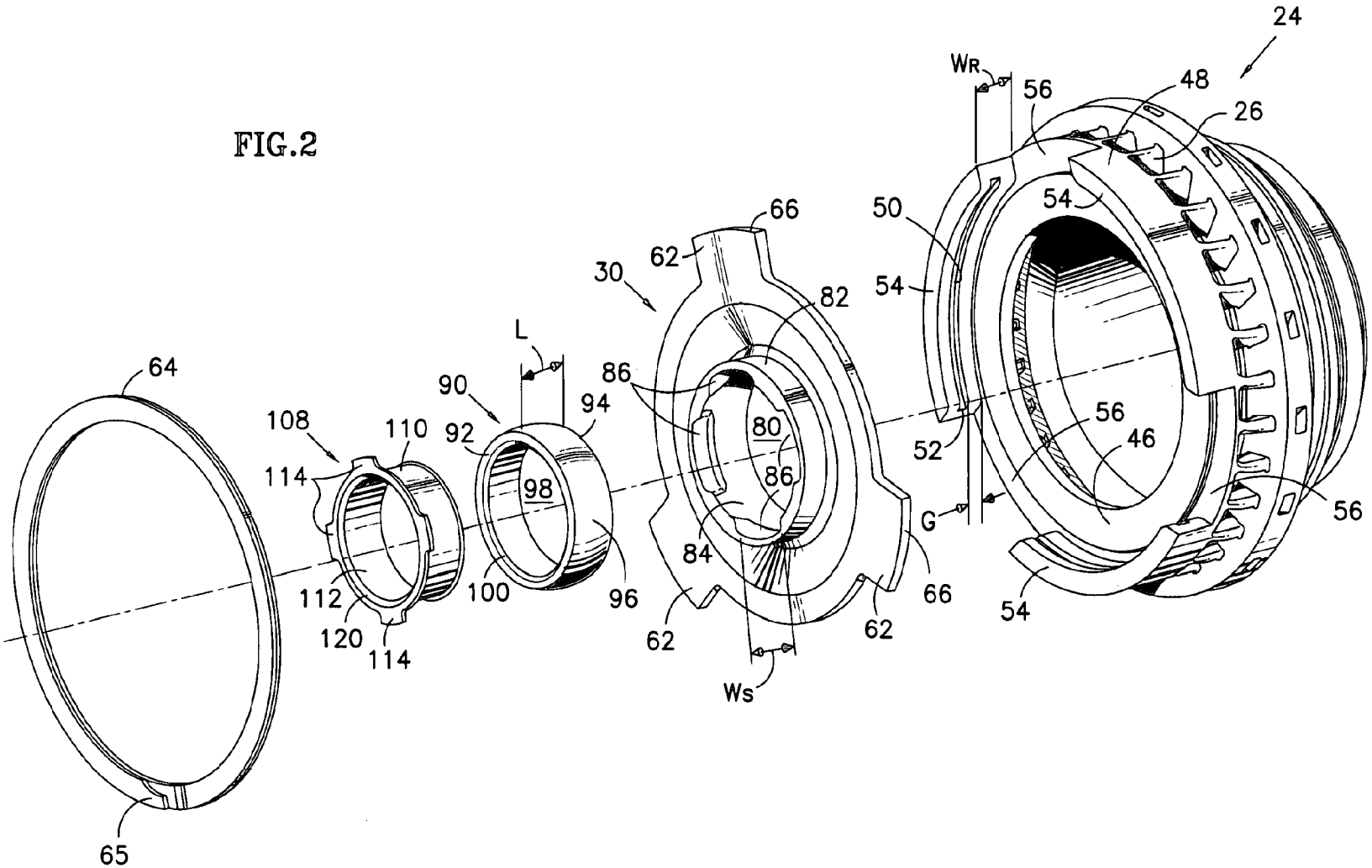
FIGS. 2 and 3 are exploded and assembled perspective views of the assemblies of FIG. 1.
Figure 2A:
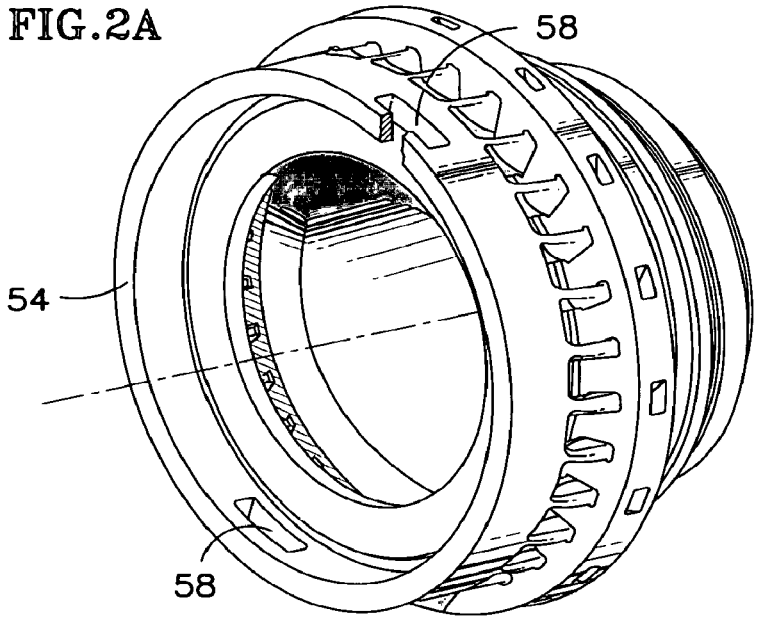
FIG. 2A is a perspective view of the swirler of FIG. 2 showing an alternate configuration.
Figure 3:
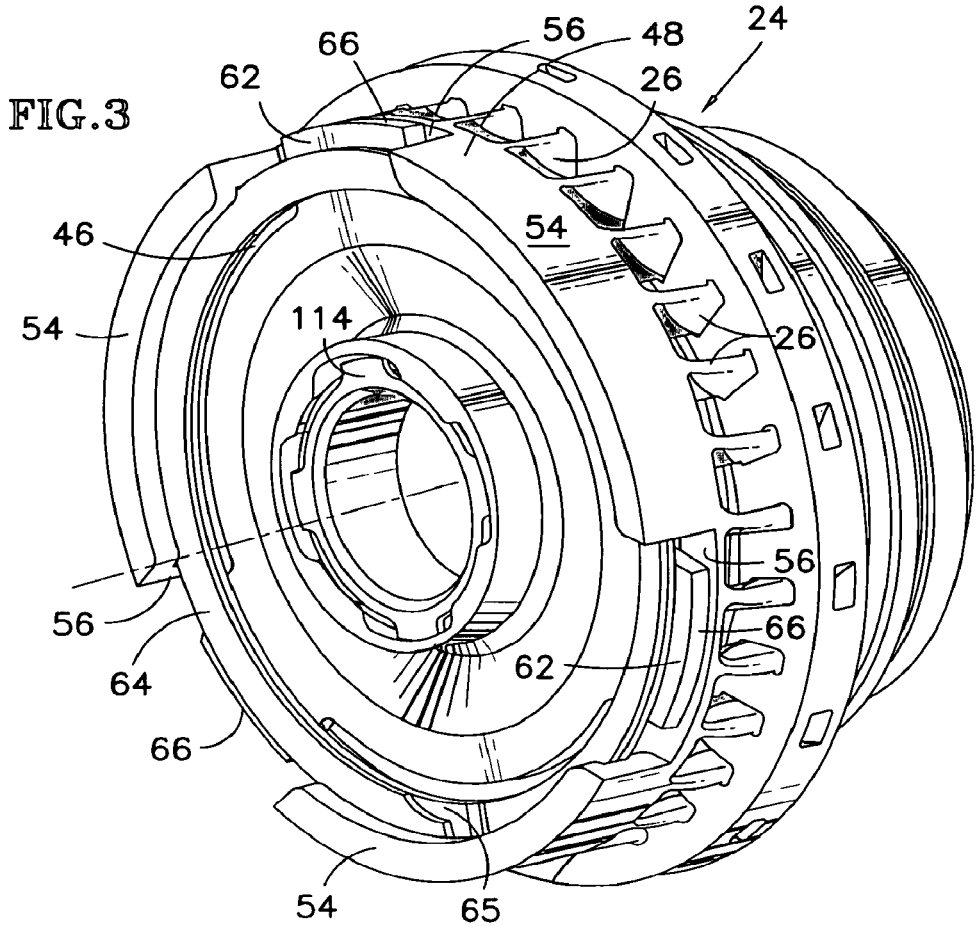

FIGS. 2 and 3 illustrate the preferred embodiments of an air swirler assembly and a bearing plate assembly, which is a component of the swirler assembly. The swirler 24 includes a forward face 46 and a segmented, circumferentially extending rail 48 of axial width $W_R$. A groove 50 extends circumferentially along the radially inwardly facing surface of the rail. Aft edge 52 of the groove is axially offset from the face 46 by a distance G. The rail and groove could be circumferentially continuous, however in the preferred embodiment the rail is divided into three segments 54 by three equiangularly distributed interruptions 56. Ideally, each interruption extends the full axial width $W_R$ of the rail. Alternatively, the interruptions could be in the form of windows 58 as seen in FIG. 2A.

The bearing plate assembly includes the bearing plate 30 with three radially projecting tabs 62. Each tab occupies one of the interruptions 56 in the swirler rail. A retainer such as spiral ring 64 with a shiplapped split 65 is captured in the groove 50 to clamp the bearing plate against the swirler face 46. The clamping force, which depends in part on the offset distance G, presses the bearing plate firmly enough against the swirler face 46 to resist air leakage past the interface or contact plane 32 (FIG. 1) between the bearing plate and the swirler face. However the clamping force is weak enough to allow the bearing plate to slide or float radially and circumferentially relative to the swirler in response to influences such as differential thermal growth. The bearing plate is dimensioned so that the outer edges 66 of all three tabs will always be axially trapped behind the retainer, irrespective of the actual position of the bearing plate in relation to the swirler. The tabs also cooperate with the neighboring rail segments 54 to limit rotation of the bearing plate relative to the swirler. Limiting the rotation is desirable to prevent excessive wear. Finally, the tabs help resist any tendency of the bearing plate to wobble and locally separate from the swirler face 46. We have concluded that three tabs provide better wobble resistance than two tabs.

Ideally, the retainer is the illustrated spiral ring 64, which can be radially compressed to facilitate installation in the groove 50 or it can be circumferentially fed into the groove by way of interruptions 56. Other forms of retainer, such as a conventional snap ring can also be used.

Figure 4:
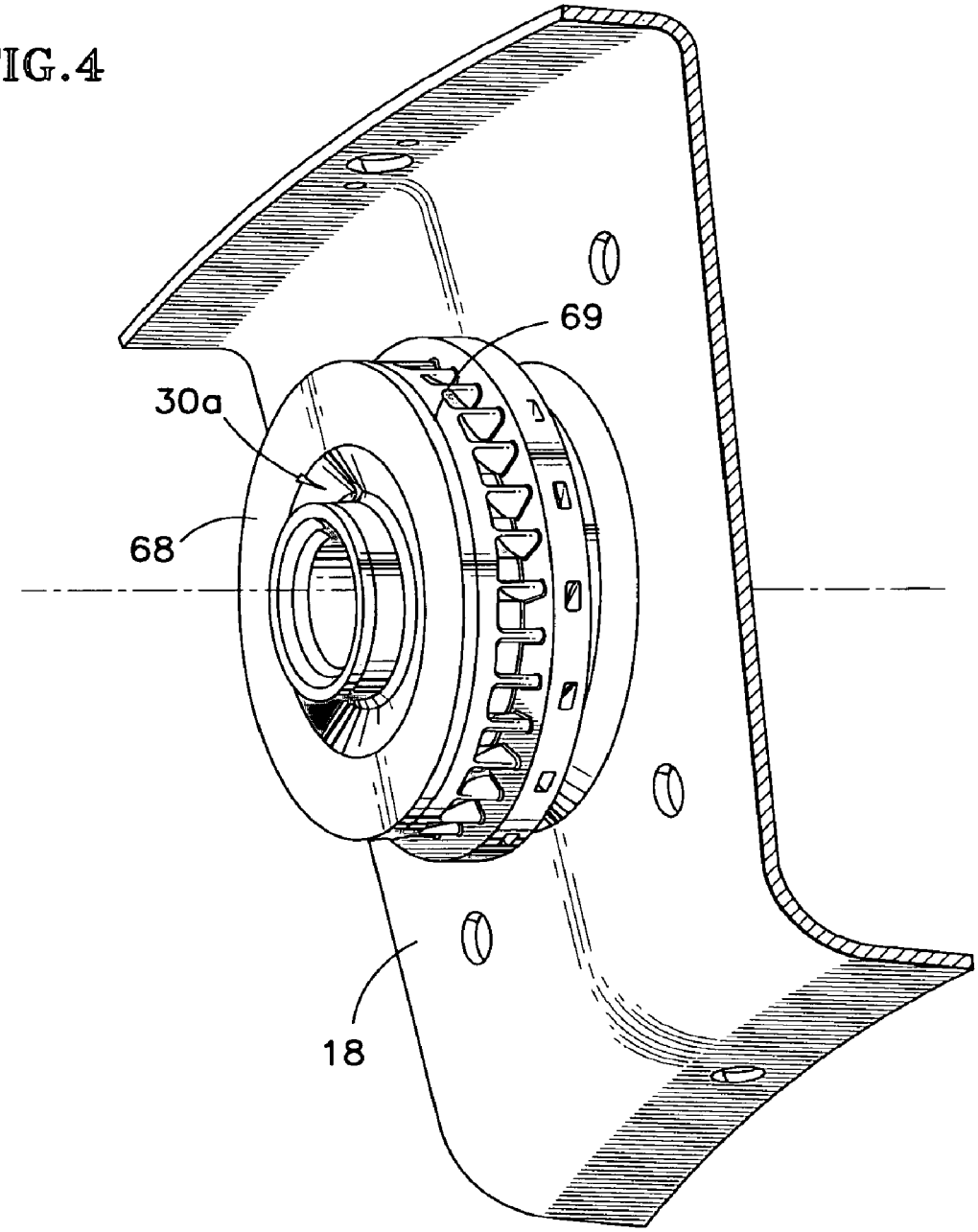
FIG. 4 is a perspective view showing an alternate way of slidably securing a bearing plate to an air swirler.
Figure 5:
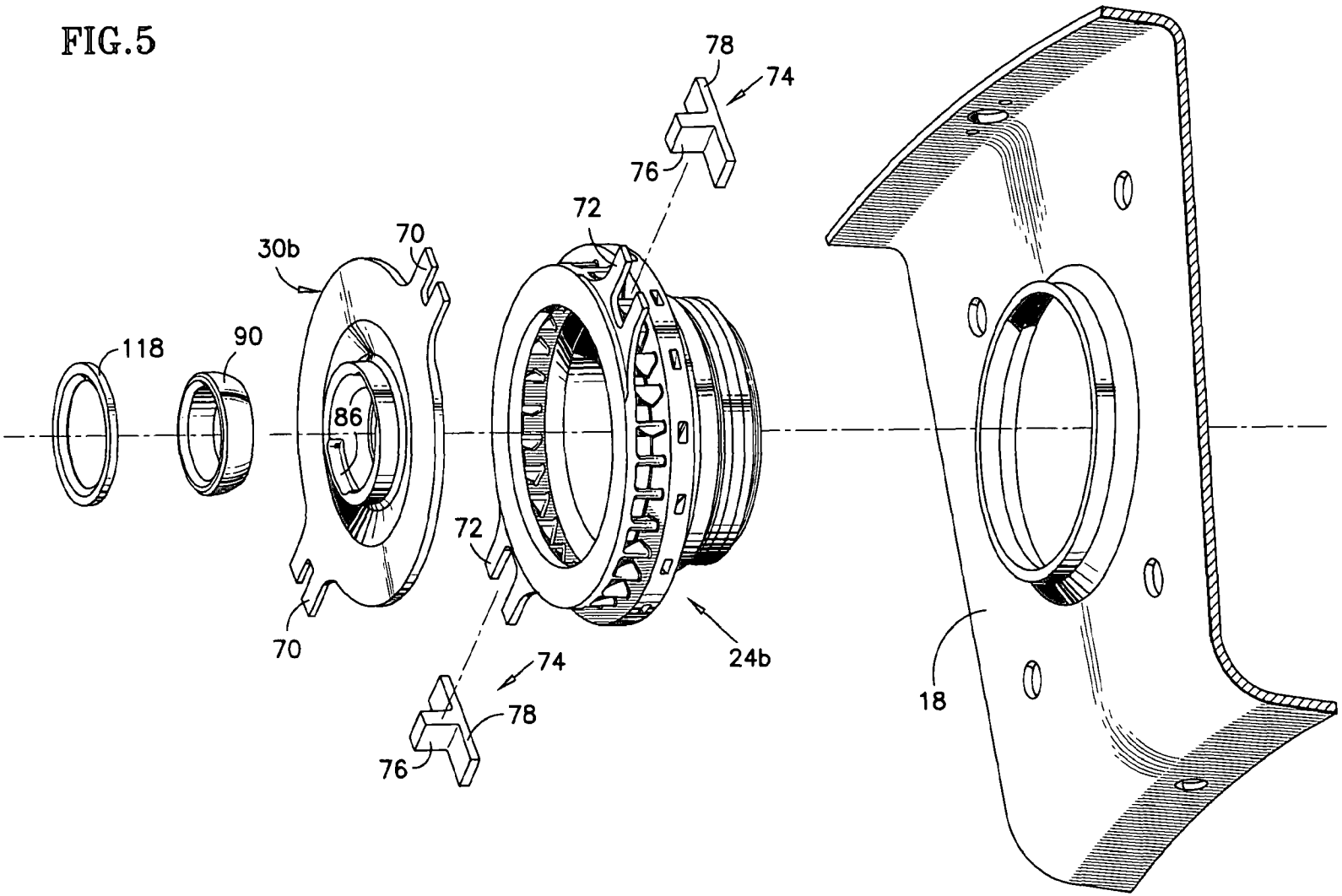
FIGS. 5 and 6 are exploded and assembled views showing another alternate way of slidably securing a bearing plate to an air swirler.
Figure 6:
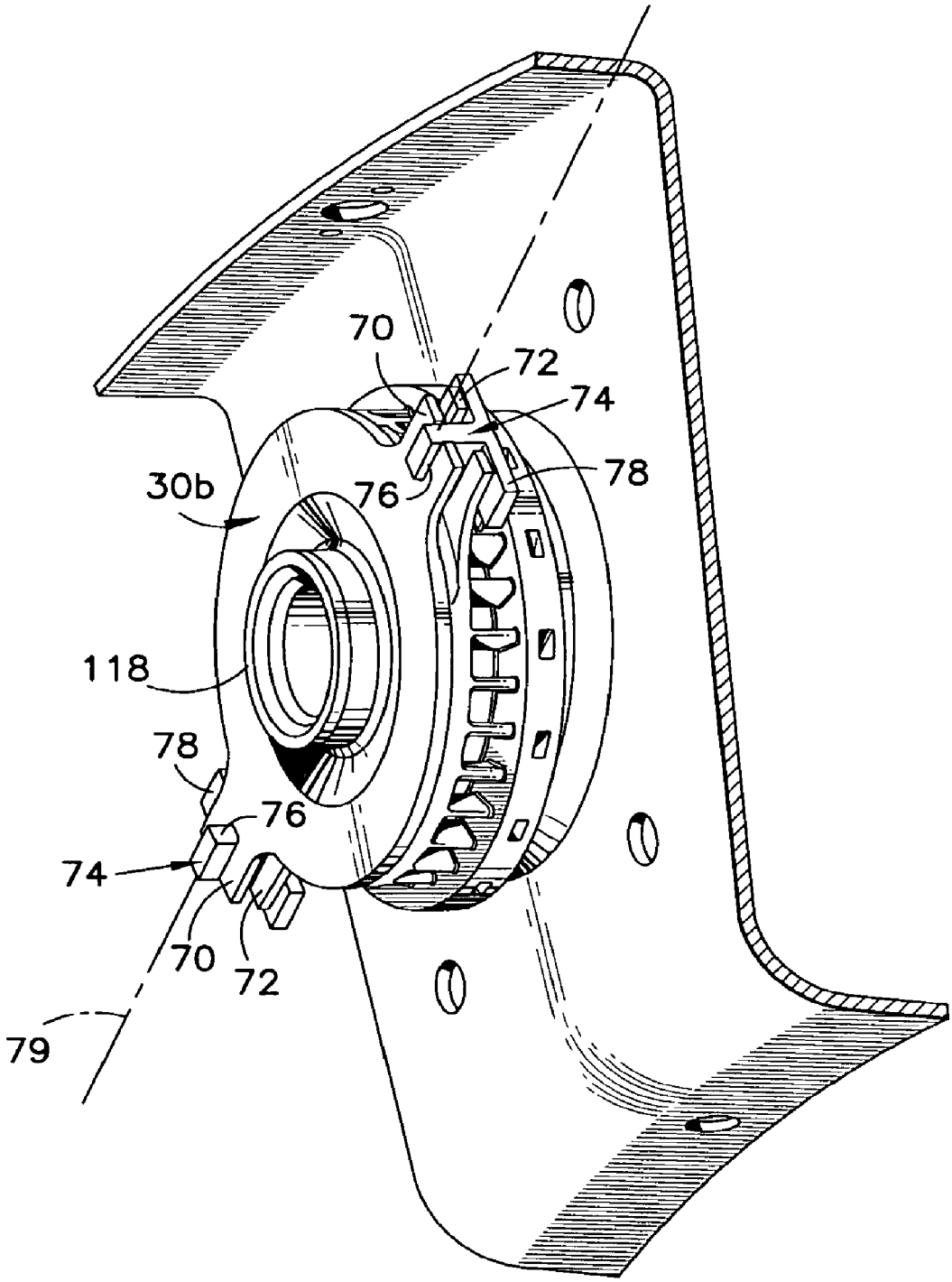

Other ways of clamping the bearing plate to the swirler, although less preferred, may also be satisfactory. FIG. 4 shows a swirler assembly in which a retaining plate 68 is welded to a swirler at weld joint 69 to axially trap the bearing plate 30*a*. FIGS. 5 and 6 show clevises 70, 72 projecting radially from bearing plate 30*b* and swirler 24*b* respectively. T-shaped pins 74 each include a tail 76 and a crossbar 78. The tail 76 of each pin extends through corresponding clevis slots and is welded or brazed to the bearing plate clevis 70 to slidably clamp the bearing plate to the swirler. The slots in the swirler clevises 72 are circumferentially wide enough that the bearing plate, although confined to contact plane 32 (FIG. 1) can translate both parallel and perpendicular to line 79.

Referring again to FIGS. 2 and 3, the bearing plate 30 has a central opening 80 bordered by a slightly axially elongated race 82. Radially inner surface 84 of the race is a curved surface, specifically a spherical surface. Two pairs of diametrically opposed loading slots 86 are provided at the forward end of the race. Each slot has a circumferential width $W_S$. In a less preferred embodiment, only one pair of loading slots is present as seen in FIG. 5.

Figure 7:
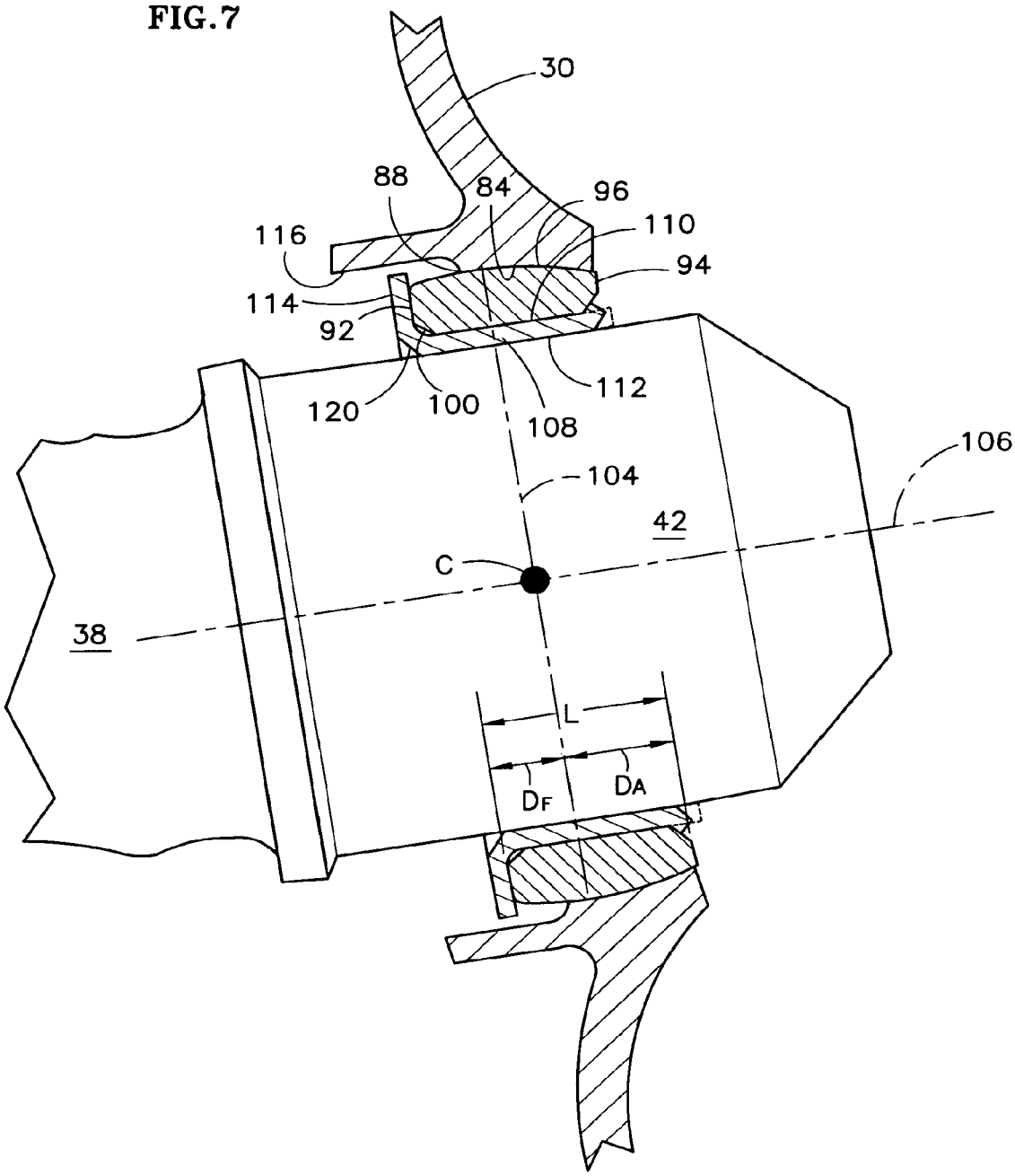
FIG. 7 is an enlarged, cross sectional side elevation view showing additional details of the preferred embodiment of the bearing plate assembly of the present invention.

Referring additionally to FIG. 7, a swivel ball 90 has a forward end 92, an aft end 94, a curved outer surface 96 and a cylindrical central opening 98. The outer surface 96 is the same shape as the race inner surface 84 and therefore is ideally a spherical surface with a center of curvature C. A chamfer 100 borders the forward end of the opening 98. The swivel ball has an axial length L slightly less than the circumferential width $W_S$ of the loading slots 86 at the forward end of the bearing plate race. The swivel ball is installed in the race by a technician who orients the ball with its length L aligned in the same direction as the width $W_S$ of one of the pairs of loading slots 86. The technician then inserts the ball into the race by way of the loading slots and pivots the ball 90 degrees into its assembled position seen best in FIG. 7. In the assembled state, the swivel ball nests snugly inside the bearing plate race to resist air leakage past the interface between the race inner surface 84 and the swivel ball outer surface 96.

The bearing plate and swivel ball are made of Stellite 6B or Stellite 31 cobalt base alloy (AMS specifications 5894 and 5382 respectively) both of which exhibit a low coefficient of friction at elevated temperatures.

The swivel ball is asymmetric about a plane 104 that is perpendicular to the swivel ball axis 106 and passes through the center C of spherical outer surface 96. The outer surface 96 extends a distance $D_F$ forward of the plane, but extends a greater distance $D_A$ aft of the plane. The asymmetry reduces the axial length of the ball, which can be important in aircraft engines where space is at a premium and extra weight is always undesirable. The polarity of the asymmetry ($D_A$ exceeding $D_F$) results in a larger fraction of the area of surface 96 residing aft of the plane 104 than forward of the plane. This can be important because during engine operation, local pressure differences cause the swivel ball to be urged aftwardly (to the right in FIG. 7). The larger surface area aft of plane 104 helps distribute the resulting loads more widely over the race inner surface 84, thereby reducing stresses on the ball and the race.

A fuel nozzle tip bushing 108 serves as a lock to prevent the swivel ball from pivoting into an orientation that would allow it to back out of the loading slots and become disengaged from the bearing plate race. The bushing has a radially outer cylindrical surface 110 whose diameter is nearly equal to the diameter of opening 98 in the swivel ball. The bushing also has a radially inner cylindrical surface 112 whose diameter is nearly equal to the diameter of the cylindrical portion 42 of the fuel injector nozzle 38. A chamfer 120 borders the forward end of cylindrical surface 112. Ears 114, extend radially from the forward end of the bushing and into close proximity with race surface 116. The aft end of the bushing is plastically deformable. During assembly operations, a technician presses the bushing into the central opening of the swivel ball until the ears 114 enter the loading slots 86. The chamfer 100 on the swivel ball helps guide the bushing into the opening. The technician then deforms the aft end of the bushing so that the deformed end grasps the aft end of the swivel ball. In FIG. 7, the deformed state of the bushing is shown with solid lines, the undeformed state is shown in phantom. The bushing is made of Haynes 25 cobalt base alloy (AMS specification 5759).

With the bushing installed as described above, the swivel ball can swivel inside the race, but not enough to allow the ball to back out of the loading slot 86. Excessive ball rotation is prevented because the ears 114 contact race surface 116, which resists further rotation. For example, if the ball of FIG. 7 were to swivel clockwise about an axis perpendicular to the plane of the illustration and extending through C, the ear (near the top of the illustration) would contact race surface 116, which would prevent further rotation.

FIGS. 5 and 6 show an alternate lock in the form of a ring 118 welded, brazed or otherwise secured to the bearing plate. The ring 118 is radially thick enough to block excessive rotation of the swivel ball. Although the ring 118 is shown in the context of an alternate embodiment of the invention, it may also be used with the preferred embodiment of FIGS. 1, 2, 3 and 7.

FIG. 7 shows a fuel injector assembly with the cylindrical portion 42 of a fuel injector nozzle extending through the cylindrical central opening 98 in the swivel ball. The diameter of the cylindrical opening 98 is nearly equal to that of the cylindrical portion 42 of the fuel injector to prevent air leakage. Chamfer 120 facilitates blind assembly of the fuel nozzle into the opening 98. During engine operation, the bearing plate is translatable radially and circumferentially relative to the swirler to accommodate movement of the nozzle due to differential thermal growth or other influences. The ball is rotatable within the bearing plate race about center C to accommodate rotation of the nozzle.

Although the invention has been described in the context of an annular combustor, its applicability extends to other combustor architectures, such as can and can-annular combustors.

Although this invention has been shown and described with reference to a specific embodiment thereof, it will be understood by those skilled in the art that various changes in form and detail may be made without departing from the invention as set forth in the accompanying claims.

We claim:

1. A nozzle tip bushing for a fuel injector assembly, the nozzle tip bushing having a cylindrical inner surface for receiving a fuel injector nozzle having a cylindrical portion, the cylindrical inner surface having a diameter nearly equal to that of the cylindrical portion of the fuel injector nozzle, and wherein the nozzle tip bushing has a plastically deformable aft end.

2. The nozzle tip bushing of claim 1 comprising ears extending radially from a forward end of the bushing.

3. The nozzle tip bushing of claim 1 wherein the plastically deformable aft end is movable between an initial assembly position comprising an undeformed condition and a final assembly position comprising a deformed condition.

4. The nozzle tip bushing of claim 1 including a plurality of ears extending radially outwardly relative to a nozzle center axis from a forward end of the bushing, with each ear being circumferentially spaced apart from each other about the nozzle center axis.

5. The nozzle tip bushing of claim 4 wherein the plurality of ears comprises at least one pair of ears.

6. The nozzle tip bushing of claim 5 wherein the at least one pair of ears comprises two pairs of ears.

7. The nozzle tip bushing of claim 4 wherein each ear is receivable within a bearing plate loading slot.

8. The nozzle tip bushing of claim 1 wherein the nozzle tip bushing has a radially outer cylindrical surface having a diameter nearly equal to that of an opening in an associated swivel ball to provide an engagement surface between the swivel ball and the nozzle tip bushing.

9. The nozzle tip bushing of claim 1 wherein the plastically deformable aft end is configured to face a combustion chamber.

10. The nozzle tip bushing of claim 9 wherein the nozzle tip bushing extends along a length from a fore end to the plastically deformable aft end that faces the combustion chamber, the aft end comprising a plastically deformed bushing portion that is formed subsequent to installation in a swivel ball.

11. The nozzle tip bushing of claim 1 wherein the plastically deformable aft end is configured to grasp a swivel ball mounted on the nozzle tip bushing.

12. The nozzle tip bushing of claim 1 wherein the plastically deformable aft end includes a swivel ball contact surface configured to provide grasping engagement with a swivel ball.

* * * * *